US005263593A

United States Patent [19]

Aida

[11] Patent Number: 5,263,593

[45] Date of Patent: Nov. 23, 1993

[54] CASING FOR WRITING UTENSILS AND THE LIKE

[75] Inventor: Masaaki Aida, Tokyo, Japan

[73] Assignee: Midori Co., Ltd., Tokyo, Japan

[21] Appl. No.: 785,749

[22] Filed: Oct. 31, 1991

[30] Foreign Application Priority Data

Oct. 31, 1990 [JP] Japan ..... 2-114195[U]

[51] Int. Cl.[5] ..... B43M 17/00

[52] U.S. Cl. ..... 211/69.1; 211/69.7; 248/205.8

[58] Field of Search ..... 211/69.1, 69.5, 69.6, 211/69.7; 248/205.8, 362, 363

[56] References Cited

U.S. PATENT DOCUMENTS

| | | | |
|---|---|---|---|
| 1,076,841 | 10/1913 | Ridderhof | 211/69.1 |
| 1,629,574 | 5/1927 | Hanle | 211/69.7 |
| 1,877,570 | 9/1932 | FitzGerald | 211/69.7 |
| 2,009,360 | 7/1935 | Koch | 211/69.5 |
| 2,297,806 | 10/1942 | Smith | 211/69.1 |
| 3,120,216 | 2/1964 | Meinhardt | 211/69.6 |
| 4,374,565 | 2/1983 | Neumann | 211/69.5 |
| 4,813,640 | 3/1989 | Perentin | 248/205.8 |
| 5,031,865 | 7/1991 | Blattner | 248/205.8 X |
| 5,104,077 | 4/1992 | Liu | 248/205.8 |

FOREIGN PATENT DOCUMENTS

| | | | |
|---|---|---|---|
| 650272 | 10/1962 | Canada | 211/69.1 |
| 446868 | 5/1936 | United Kingdom | 248/205.8 |
| 470723 | 8/1937 | United Kingdom | 248/205.8 |
| 975271 | 11/1964 | United Kingdom | 248/205.8 |

*Primary Examiner*—David A. Scherbel
*Assistant Examiner*—Derek J. Berger
*Attorney, Agent, or Firm*—Wenderoth, Lind & Ponack

[57] ABSTRACT

A casing for containing writing utensils or the like comprises a casing body for containing any desired number of writing or other utensils, and an annular supporting member for supporting the casing body such that it can be pivoted from a horizontal to a substantially vertical position. A suction member is located such that its working surface is spaced away from the lower end of the annular supporting member, and a position regulating mechanism is provided for pivotally supporting the annular supporting member. The position regulating mechanism is adapted to displace the working surface of the suction member between a first position at which it comes into close contact with an object and a second position at which it does not.

7 Claims, 6 Drawing Sheets

CASING FOR WRITING UTENSILS AND THE LIKE

BACKGROUND OF THE INVENTION

1. Field of the Invention

The present invention relates to a casing for writing utensils and the like and, more particularly, to a casing for writing utensils and the like which functions not only to contain objects such as writing utensils, but also as a stand for writing utensils.

2. Prior Art

Writing kits for containing a required number of writing utensils such as automatic pencils or ball-point pens, and pen stands for containing them individually in an inclined or upright state have heretofore been put to practical use.

However, such conventional writing kits and pen stands serve their own intended purposes alone. No kit or casing providing both of these functions and which is easy to handle is available.

In view of the foregoing, the present invention seeks to provide a casing for writing utensils or the like, which can not only accommodate them but also serves as a stand for a pen or the like, and which is easier to handle and has a better handling design.

SUMMARY OF THE INVENTION

Thus, the present invention provides a casing for containing writing utensils or the like, which comprises a casing body for containing any desired number of utensils of interest such as writing utensils, an annular supporting member for supporting the casing body such that it can be turned from a horizontal to a substantially vertical position, a suction member located such that its working surface is spaced away from the lower end of the annular supporting member, and a position regulating mechanism for pivotally supporting the annular supporting member and adapted to displace the working surface of the suction member from a first position at which it comes into close contact with an object to a second position at which it does not, and vice versa.

With this construction, the casing body with any desired number of writing utensils contained therein is supported by the annular supporting member such that it can be turned from a horizontal to a substantially vertical position, and the annular supporting member is turnable around the position regulating mechanism. Moreover, the suction member located on the lower end of the annular supporting member can be displaced between the first and the second position upon turning of the position regulating mechanism.

Thus, the casing according to this invention can not only contain any desired number of various writing utensils, but can also serve as a stand for them, when it is fixed to a suitable object. In addition, once in place, the casing itself can be turned through a certain regulatable angle in every direction. The casing can also be easily engaged with or disengaged from the suitable object.

BRIEF DESCRIPTION OF THE DRAWINGS

The present invention will now be explained more illustratively but not exclusively with reference to the accompanying drawings, in which.

DETAILED EXPLANATION OF THE INVENTION

The present invention will now be explained in greater detail with reference to an embodiment in which the utensils of interest are writing utensils.

A casing for writing utensils or the like, generally shown at 1, comprises a casing body 3 for containing three writing utensils, e.g., automatic pens, ball-point pens and marker pens; an annular member 4 for supporting one end of the casing body 3 such that the casing body 3 is pivotable through an angle of 0° to about 90° in the directions $\alpha_1$ and $\alpha_2$, i.e., between a horizontal position and a vertical position; a suction member 5 including a suction cup element made of an elastomer and having a working face spaced away from the lower end of the annular supporting member 4 and a shaft 5*a* extending vertically from a central part of the suction cup element; and a position-regulating mechanism 6 which supports the annular supporting member 4 such that the annular supporting member 4 can be fully rotated thereabout and such that the working face of the suction member 5 can be displaced from a first position at which it comes into close contact with an object M (e.g., the upper or side face of a desk) to a second position at which it does not, and vice versa.

Figure 4:
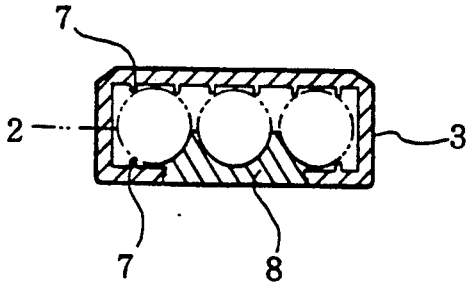
FIG. 4 is a sectional view taken along line I—I of FIG. 1.

As illustrated in FIG. 4, the casing body 3 includes sets of small longitudinally extending ribs 7 positioned to correspond to the thicknesses of the writing utensils 2. The inner wall of the body 3 is made of a material such as a sponge material or a rubber material, and is curved to follow the curvature of the circumference of the writing utensils 2. A retainer 8 is provided for holding the writing utensils 2 set in place.

The casing body 3 is provided at one end with a pair of cylindrical extensions 3*a* in rectangular form, which are provided with receiving holes 9 in opposing positions.

The annular supporting member 4 is provided with a pair of engaging lips 10*a* and 10*b* between which the pair of cylindrical extensions 3*a* are located. By passing a sleeve (12) and pin (13) arrangement through a pair of holes 11*a* and 11*b* formed in the lips 10*a* and 10*b* and the pair of receiving holes 9, the casing body 3 is pivotally attached to the annular supporting member 4.

The position regulating mechanism 6, in a substantially cylindrical form, includes: a cylindrical member 15 comprising an upper collar 15*a*, a cylindrical wall which has two claws 15*b* at its lower portion, and an inner bottom 15*c* with a centrally formed hole 15*d* through which the shaft 5*a* of the suction member 5 can pass; a cam member 16 rotatably mounted on the inner bottom 15*c* of the cylindrical member 15 and including an upper cam surface 16a and a pair of diametrically arranged claws 16b; a circular rotary dial ring 17 fitted from above the cam member 16 into an open portion of the cylindrical member 15; a pin 18 adapted to be inserted into a lateral hole 5b in the shaft 5a which projects through a hole 16c formed in the cam member 16 in coaxial relation with the hole 15d to thereby hold the cam member 16 on the inner bottom 15c; and an annular packing 19 located between the inner circumference of the annular supporting member 4 and the collar 15a. The cam member 16 and the pin (or cam follower) 18 together constitute a vertical moving means for moving the suction member 5 vertically upon rotation of the rotary dial 17.

The claws 15b of the cylindrical member 15 abut, from below, against a circular rib 4a formed on the inner circumference of the annular supporting member 4, thus enabling the annular supporting member 4 to rotate around the cylindrical member 15 without being disengaged therefrom.

The suction member 5 is provided with lugs 5c around its shaft 5a, while the hole 15d in the cylindrical member 15 is provided with slots 15e having profiles complementary to the lugs 5c, to thereby prevent the suction member 5 and the cylindrical member 15 from being separately rotated while the shaft 5a is inserted into the hole 15d.

Figure 7:
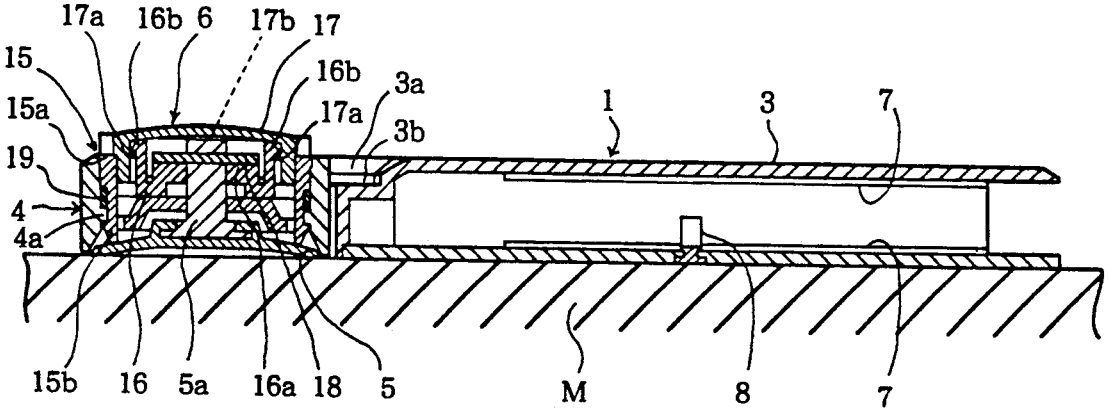
FIG. 7 is a sectional view of the invention with the suction member in operation.

As illustrated in FIG. 7, the dial ring 17 is provided on its inside with a pair of claws 17a which are in engagement and mesh with the claws 16b of the cam member 16, so that an external (or rotational) force applied to the dial ring 17 is transmitted to the cam member 16.

The upper cam surface 16a of the cam member 16 is provided with a small linear recess 16d extending on opposing sides of the hole 16c, in which the aforesaid pin 18 is embedded. The arrangement of the cam member 16 and holding pin 18 is illustrated in FIG. 2.

Figure 5:
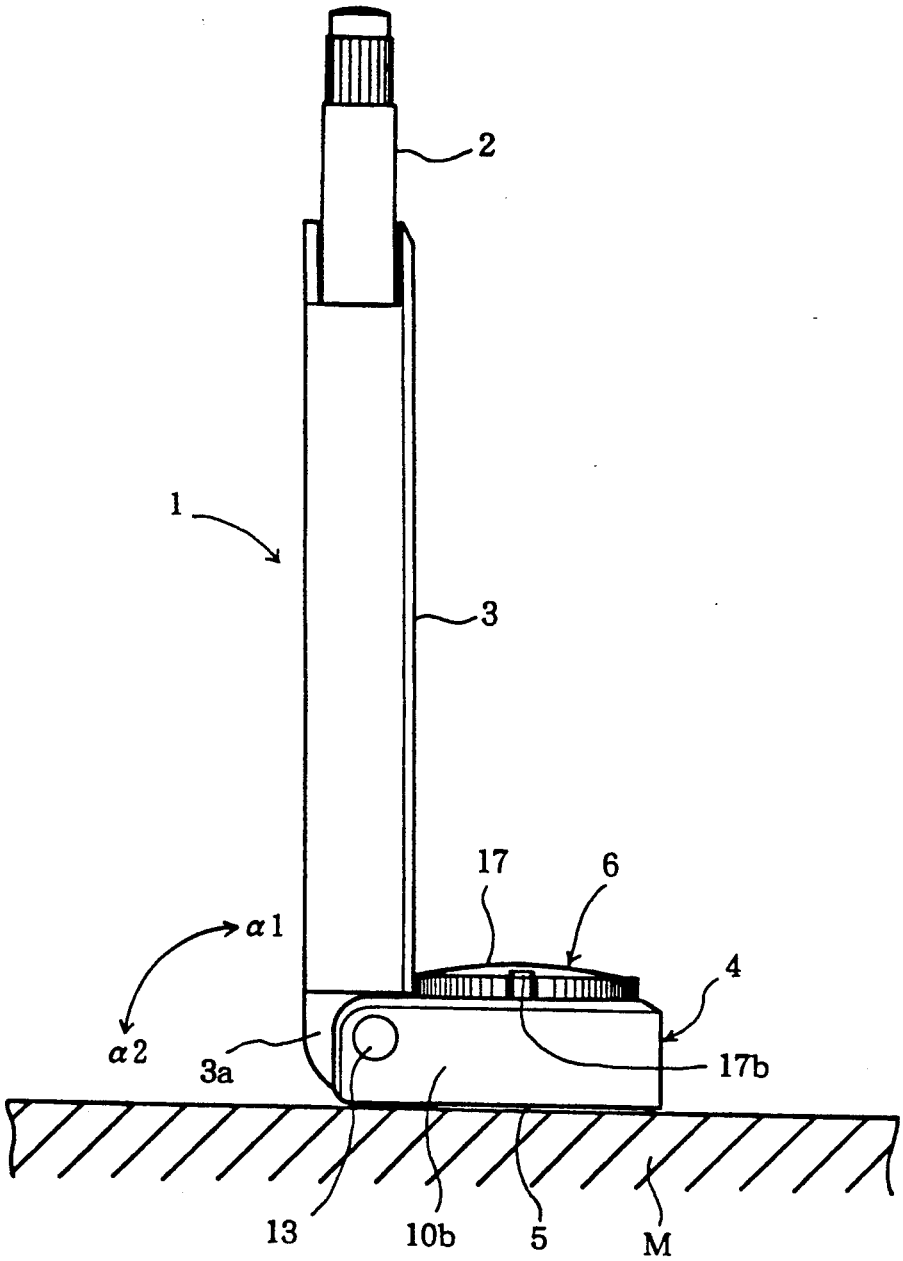
FIG. 5 is a side view of the casing according to the present invention which is turned through 90° with its suction member being in operation.
Figure 6:
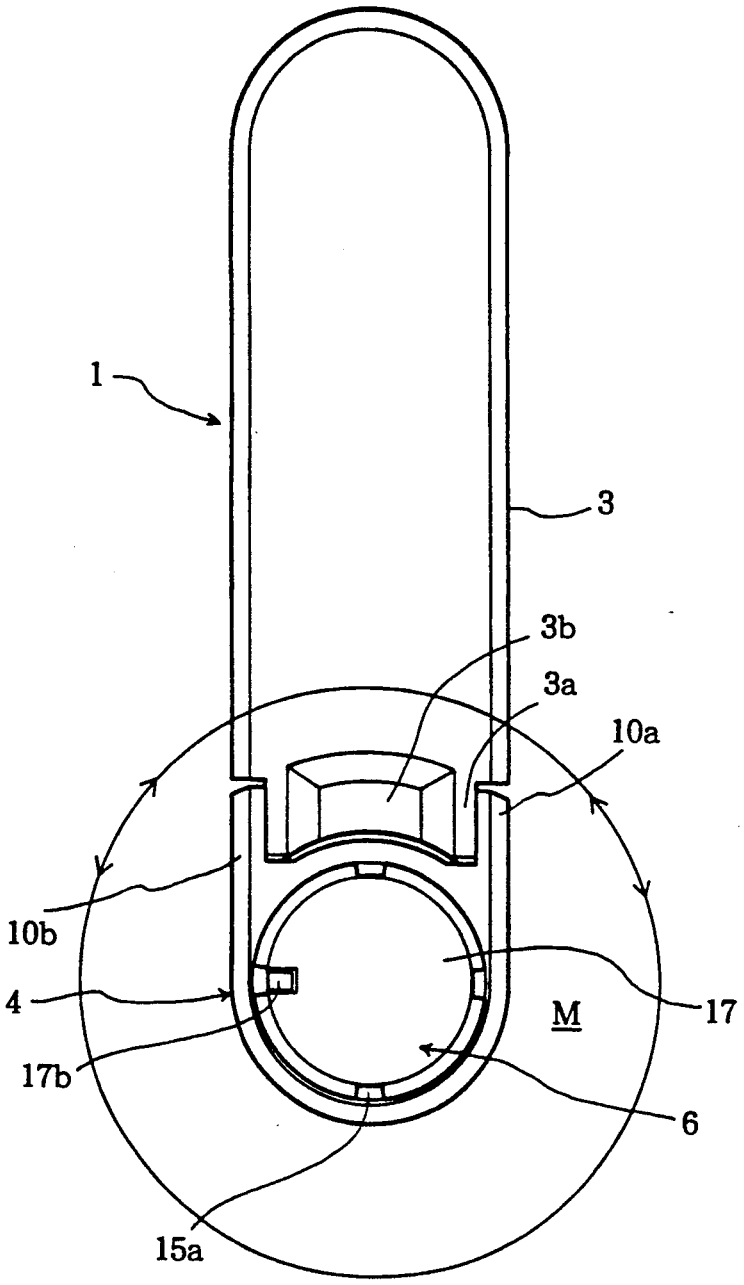
FIG. 6 is a view illustrative of the casing when it is turned with its suction member in operation.

The dial ring 17 is provided with a rectangular notch 17c in its periphery, which is to receive a marker member located at one end of the cam member 16 and shown at 17b. When the marker member 17b is positioned as shown in FIGS. 5, 6 and 7, the suction member 5 is brought into close contact with the upper surface of the object M so that the annular supporting member 4 can be held in place. When the marker member 17b is positioned as shown in FIGS. 1 and 2, on the other hand, the suction member 5 is out of action or deactivated.

According to the arrangement of the present invention as above-described, the cam member 16 is made to rotate in the cylindrical member 15 simultaneously with the rotational movement of the dial ring 17, but the cylindrical member 15 and the suction member 5 do not rotate.

Figure 1:
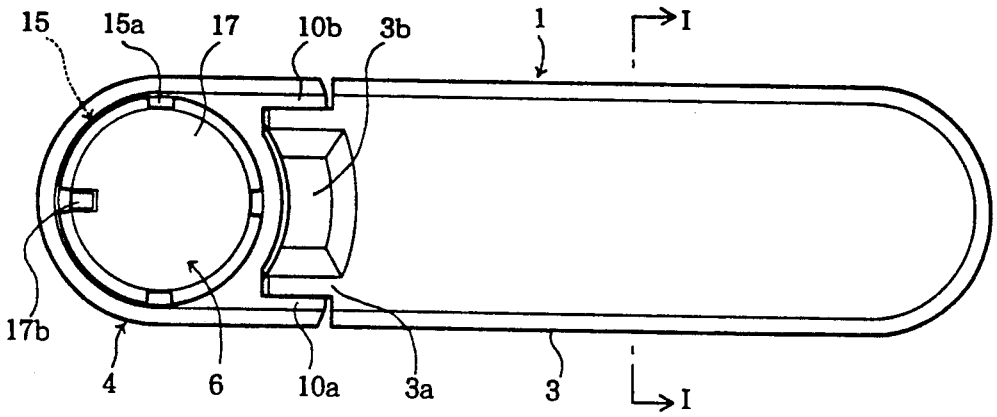
FIG. 1 is a plan view of one embodiment of the casing for writing utensils or the like according to the present invention, with its suction member being out of operation.
Figure 2:
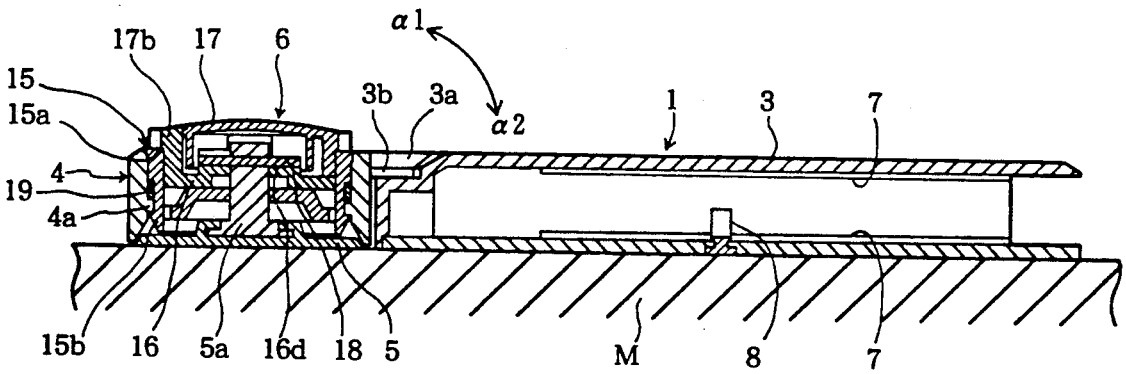
FIG. 2 is a sectional view of the FIG. 1 embodiment, again with its suction member being out of operation.
Figure 3:
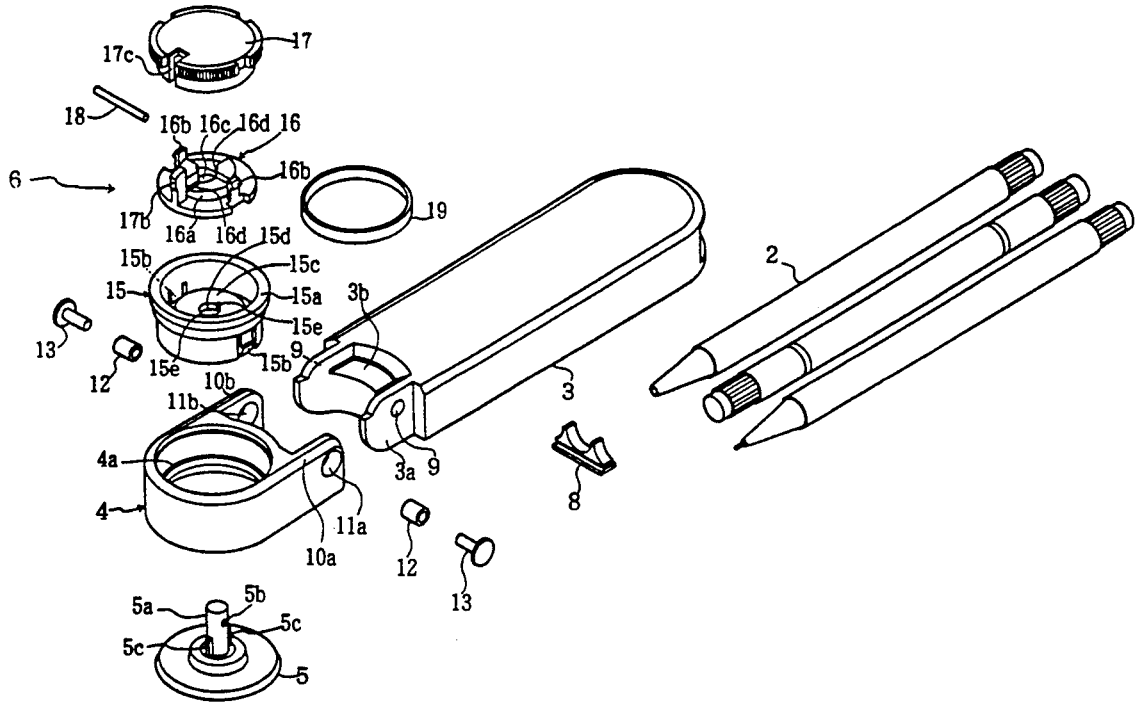
FIG. 3 is an exploded perspective view of the FIG. 1 embodiment.

When the pin 18 is positioned in the small recess 16d in the cam member 16, the shaft 5a of the suction member 5 moves downwardly with the central portion of the bottom of the suction member 5, as shown in FIGS. 1 and 2, thus keeping the suction member 5 from working. When the dial ring 17 is turned to displace the pin 18 from within the small recess 16d onto the upper cam surface 16a, on the other hand, the shaft 5a of the suction member 5 moves upwardly to form a suction space as depicted in FIG. 7 to allow the suction member 5 to work. Thus, operation of the suction member 5 is easily achieved by turning the dial ring 17.

It is noted that the dial ring 17 is serrated to make it easier to handle. Also, it is understood that reference numeral 3b refers to a groove for making 90 degrees pivoting of the casing body 3 smoother.

The operation and use of the casing 1 for writing utensils will now be described with reference to the accompanying drawings.

When the marker member 17b on the dial ring 17 of the casing 1 is positioned as shown in FIGS. 5–7 and the suction member 5 is fixed onto the object M as shown in FIG. 7, the annular supporting member 4 is held in place through the shaft 5a and cylindrical member 15. Moreover, the annular supporting member 4 is ready to be rotated 360 degrees around the cylindrical member 15 as illustrated in FIG. 6, and the casing body 3 is ready to be pivoted in the directions $\alpha_1$ and $\alpha_2$ with respect to the annular supporting member 4 as illustrated in FIG. 5. Thus, the casing body 3 is easy to handle and can be used as a writing utensil stand capable of being uniquely rotated.

In order to disengage the casing 1 from the object M, the dial ring 17 is turned to move the marker member 17b 90 degrees from the position shown in FIGS. 5–7 to the position shown in FIG. 2.

This then causes the cam member 16 to turn with the dial ring 17 through an angle of 90°, enabling the pin 18 to engage within the small recess 16d in the upper cam surface 16a, so that the central shaft 5a of the suction member 5 is moved into its lower position shown in FIG. 2. Then, the central part of the lower surface of the suction member 5 abuts against the object M, enabling air to flow into a space above the bottom of the suction member 5. This then provides an easy disengagement of the casing 1 from the object M, such that the casing 1 can be removed and carried away.

While the present invention has been described with reference to the foregoing specific embodiment, it is understood that various modifications may be possible within the scope of the invention.

For instance, it is understood that the number of writing utensils 2 contained in the casing body 3 is not limited to three, and that a set of toothbrushes, screw drivers or other utensils may be contained in place of the writing utensils.

As an alternative to the suction member 5, a magnet or the like may be used. Moreover, the provision of, e.g., a U-shaped, thin and small projection at a central position of the bottom of the suction member 5 permits air to flow through a notch in the small projection, rendering deactivation of the suction member easier.

What is claimed is:

1. A casing for use in containing at least one utensil and in supporting the at least one utensil on an object, said casing comprising:

an annular supporting member having an upper end, a lower end, and a vertical central axis;

a suction member mounted to said annular supporting member for adhering said annular supporting member to the object;

a position regulating mechanism for use in selectively moving said suction member between a first position in which a bottom surface of said suction member is adapted to be in close contact with the object and a second position located upwardly of said first position, said position regulating mechanism comprising a rotary dial rotatably mounted to said annular supporting member for rotation about said central axis, and a vertical moving means for causing said suction member to move between said first and second positions in response to rotation of said rotary dial; and an elongated casing body, adapted to contain the at least one utensil, pivotally mounted to said annular supporting member for pivotal movement between a horizontal position and a substantially vertical position.

2. A casing as recited in claim 1, wherein said suction member and said annular supporting member are rotatable relative to one another about said central axis, such that said annular supporting member and said casing body can be rotated relative to said suction member.

3. A casing for use in containing at least one utensil and in supporting the at least one utensil on an object, said casing comprising:

an annular supporting member having an upper end, a lower end, and a vertical central axis;

a suction member mounted to said annular supporting member for adhering said annular supporting member to the object;

a position regulating mechanism for use in selectively moving said suction member between a first position in which a bottom surface of said suction member is adapted to be in close contact with the object and a second position located upwardly of said first position, said position regulating mechanism comprising a rotary dial rotatably mounted to said annular supporting member for rotation about said central axis, and a vertical moving means for causing said suction member to move between said first and second positions upon rotation of said rotary dial;

an elongated casing body, adapted to contain the at least one utensil, pivotally mounted to said annular supporting member for pivotal movement between a horizontal position and a substantially vertical position;

wherein said vertical moving means includes a cam member having inclined cam surfaces, and a cam follower which is attached to said suction member and is operably engaged with said cam surfaces.

4. A casing as recited in claim 3, wherein said suction member includes a suction cup element and a shaft extending upwardly from said suction cup element.

5. A casing as recited in claim 4, wherein said shaft has a hole formed diametrically therethrough; and said cam follower comprises a pin extending through said hole.

6. A casing for use in containing at least one utensil and in supporting the at least one utensil on an object, said casing comprising:

an annular supporting member having an upper end, a lower end, and a vertical central axis;

a suction member mounted to said annular supporting member for adhering said annular supporting member to the object;

a position regulating mechanism for use in selectively moving said suction member between a first position in which a bottom surface of said suction member is adapted to be in close contact with the object and a second position located upwardly of said first position, said position regulating mechanism comprising a rotary dial rotatably mounted to said annular supporting member for rotation about said central axis, and a vertical moving means for causing said suction member to move between said first and second positions upon rotation of said rotary dial;

an elongated casing body, adapted to contain the at least one utensil, pivotally mounted to said annular supporting member for pivotal movement between a horizontal position and a substantially vertical position;

wherein said position regulating mechanism further includes a cylindrical member rotatably mounted in said annular supporting member;

wherein said vertical moving means comprises a cam member rotatably mounted in said cylindrical member; and wherein said rotary dial is mounted on and fixed for rotation with said cam member.

7. A casing as recited in claim 6, wherein said suction member includes a suction cup element and a shaft extending upwardly from said suction cup element;

said vertical moving means further comprises a cam follower attached to said shaft and operably engaged with said cam member;

said cylindrical member has an axially central hole formed therethrough;

said cam member has an axially central hole formed therethrough; and said shaft of said suction member extends through said axially central holes of said cylindrical member and said cam member.

* * * * *